United States Patent [19]

Popovitch et al.

[11] Patent Number: 5,067,405

[45] Date of Patent: Nov. 26, 1991

[54] SAFING AND ARMING DEVICE

[76] Inventors: Dragolyoub Popovitch, 1766 Meadowcrest Dr., Pittsburgh, Pa. 15241; Herbert L. Andrews, 4256 E. Mercer Ln., Phoeniz, Ariz. 85020

[21] Appl. No.: 507,992

[22] Filed: Apr. 12, 1990

[51] Int. Cl.[5] ..... F42C 15/23; F42C 15/26; F42C 15/34

[52] U.S. Cl. ..... 102/232; 102/240; 102/245

[58] Field of Search ..... 102/240, 231, 232, 233, 102/235, 245, 222

[56] References Cited

U.S. PATENT DOCUMENTS

| | | | |
|---|---|---|---|
| 3,516,359 | 6/1970 | Weber et al. | 102/240 |
| 4,242,963 | 1/1981 | Ziemba | 102/240 |
| 4,432,283 | 2/1984 | Duffner | 102/240 |
| 4,449,456 | 5/1984 | Foss et al. | 102/240 |
| 4,662,279 | 5/1987 | Popovitch | 102/233 |
| 4,938,138 | 7/1990 | Maruska | 102/235 |
| 4,938,139 | 7/1990 | Brede et al. | 102/233 |

FOREIGN PATENT DOCUMENTS

| | | | |
|---|---|---|---|
| 27061 | 1/1920 | Denmark | 102/240 |
| 2456936 | 1/1981 | France | 102/245 |
| 402936 | 3/1943 | Italy | 102/245 |
| 716941 | 10/1966 | Italy | 102/240 |

*Primary Examiner*—David H. Brown
*Attorney, Agent, or Firm*—William J. Ruano

[57] ABSTRACT

In a weapon subject to a sequence of high acceleration followed by high spin and including a detonator and an explosive charge; the improvement comprising a barrier having two parts located between the detonator and explosive charge to normally form an obstruction to prevent accidental detonation of the explosive charge by the detonator. Mechanical locking means are provided to lock the barrier in place, comprising a split cylinder and a spirally wound ribbon, a pair of pins restraining the outer surface of the ribbon to prevent premature unwinding. When the weapon is fired from a gun, the high acceleration will remove the pins and allow the ribbon to unwind. Upon unwinding the entire ribbon, the barrier under the action of spin, will be removed to provide an unobstructed path between the detonator and explosive charge.

5 Claims, 1 Drawing Sheet

SAFING AND ARMING DEVICE

This invention relates to a safing and arming (S & A) device which forms an integral part of a small caliber (or even high caliber) explosive shell fired at high velocity from an internally-rifled gun,—an improvement of my U.S. Pat. No. 4,662,279.

The invention is primarily intended for use in conjunction with rapid-fire small-caliber weapons. This being the case, the main factors motivating this invention are:

(a) The very small volume available for insuring the safing and arming function; and (b) The requirement that the resulting device be simple and cheap to manufacture.

BACKGROUND OF THE INVENTION

An outstanding disadvantage of present safing and arming devices is that they usually require a source of electrical power, such as a battery, which through shelfage may become inoperable; therefore making the device undependable as well as adding to size and weight of the device.

Another disadvantage is that such devices often are not dependable to assure against accidental explosion before the shell is a safe distance away from the firing gun.

SUMMARY OF THE INVENTION

The one piece barrier 5 of my patent is replaced by a two piece barrier 5*a*, 5*b* with curved surfaces in contact with a split cylinder in order to preserve the symmetry of mass distribution inside the projectile for better ballistic behavior. Anti-friction ball locking of the barrier is replaced by a locking sleeve or insert.

BRIEF DESCRIPTION OF THE DRAWING

Other objects and advantages of the invention will become more apparent from a study of the following description taken with the accompanying drawing wherein.

DESCRIPTION OF THE PREFERRED EMBODIMENT

Figure 1:
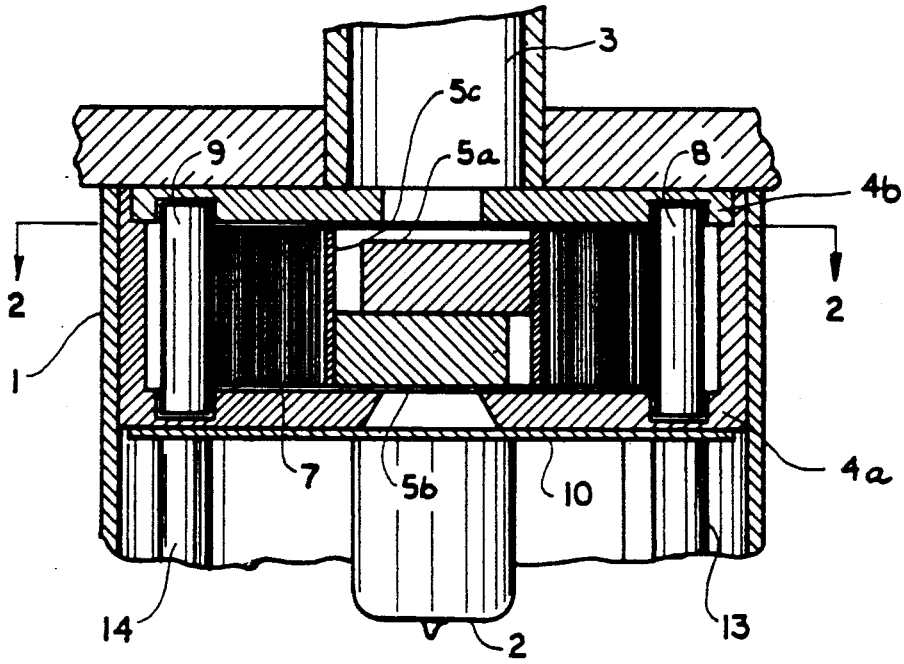
FIG. 1 is a vertical cross-sectional view taken along line 1—1 of FIG. 2 of a safing and arming device embodying the present invention.
Figure 4:
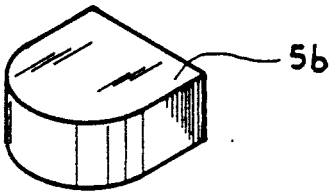
FIG. 4 is a perspective view of part 5*b*.
Figure 3:
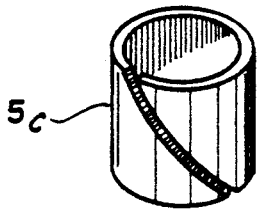
FIG. 3 is an enlarged perspective view of part 5*c*.
Figure 2:
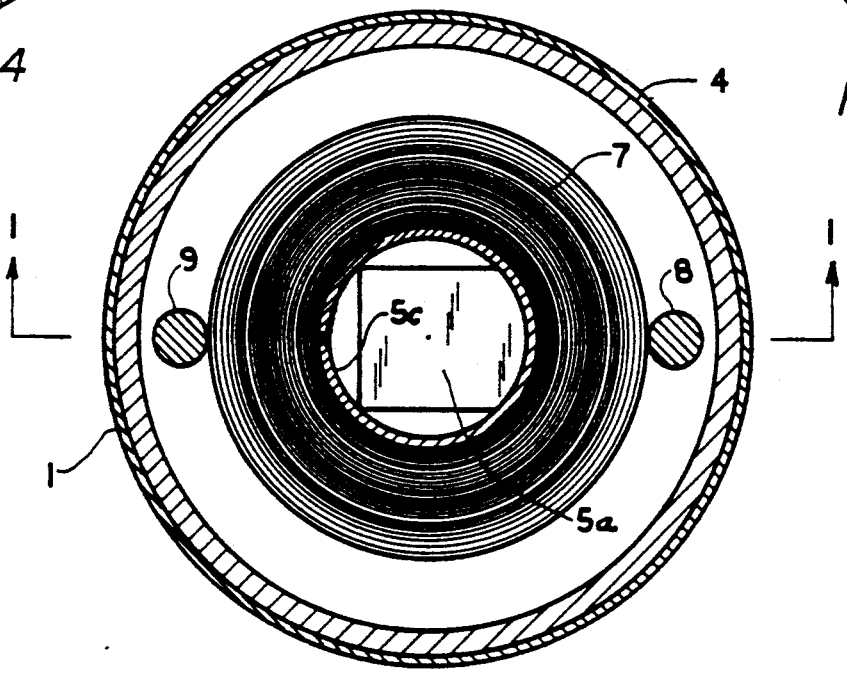
FIG. 2 is a top sectional view thereof taken along line 2—2 of FIG. 1.

Referring more particularly to FIGS. 1 and 2, numeral 1 denotes a casing for housing an assembly of fuze parts, together with a detonator 2. Above the casing 1, there is an explosive charge 3 contained in a cylindrical portion of the assembly.

The present invention is specifically directed to the safing and arming device forming an integral part of a small caliber explosive shell, which device is contained in the housing consisting of a base 4*a* and of a cover 4*b*. The device comprises a barrier 5*a*, 5*b*, both of the same shape for obstructing the path between detonator 2 and explosive charge 3, which barrier is supported on base 4*a*, around which is wound a split locking sleeve or insert 5*c* and a spiral ribbon 7, preferably of metal, of a predetermined number of turns depending upon the minimum distance from the gun at which detonation is permitted to take place.

Set-back pins 8 and 9 in the positions shown, that is, contacting the outer surface of ribbon 7, will prevent unwinding of the ribbon.

The one piece barrier 5 of my patent is replaced by a two piece barrier 5*a*, 5*b* with curved surfaces in contact with a split cylinder in order to preserve the symmetry of mass distribution inside the projectile for better ballistic behavior. Anti-friction ball locking of the barrier is replaced by locking sleeve or insert 5*c* in order to increase functioning reliability: increase the volume available for more ribbon to achieve required safe arming distance when the space for the mechanism is very restricted; simplify manufacturing and reduce the cost. Center of gravity of each half barrier is very close to the spin axis in order to minimize the centrifugal force acting on the insert and on the ribbon but big enough to reliably take the barrier out of the hub when the ribbon is unwound. A membrane 10 completes the enclosure of the spiral ribbon and associated parts, so that in the normal position, shown in FIG. 1, barrier 5*a*, 5*b* prevents any accidental setting off by the detonator 2 of the explosive charge 3. That membrane or foil may be manufactured either as a separate part pressed against the bottom of the housing, as shown in FIG. 1, or as an integral part of the housing base 4*a*, or as both, as shown in FIG. 1.

In operation, when the shell having the above-described safing and arming device is fired from a gun which is internally rifled, it will be ejected through the muzzle of the gun at high velocity and high spin because of the internal rifling. Thus, under the influence of high acceleration and high initial setback, the set-back pins 8 and 9 will puncture holes in membrane 10 and will be forced downwardly into holes 13 and 14 in either tubes or in a solid mass below membrane 10. When the set-back pins 8 and 9 move into holes 13 and 14, the spin will move them radially outwardly against outermost walls of the pockets or holes 13 and 14, since the diameters of holes 13 and 14 are larger in an outward direction than those of pins 8 and 9, as will be apparent in FIG. 1.

This will prevent return of the pins back into their normal or upper position as might otherwise happen later. Thereupon, the ribbon 7, by virtue of spin of the projectile and S & A device, will unwind, and upon complete unwinding thereof, and with the ribbon out of the way, barrier parts 5*a* and 5*b*, under the action of spin, will move radially outwardly into the space previously occupied by split cylinder 5*c* and spiral ribbon 7. Since the center-of-gravity of the barrier 5*a* and 5*b* is offset outwardly from the spin axis, the barrier will be moved, by spin, completely away from the path existing between detonator 2 and the high explosive charge 3, thereby allowing detonation of the charge because of removal of the obstacle provided by barrier 5*a*, 5*b*. For example—one layer of coil may unwind or peel off while the unit makes one revolution, equivalent to a travel equal to about 30 calibers. The larger the number of turns, the greater the safe arming distance away from the firing gun.

It should be noted that the present invention is limited in use to rounds that are fired with high acceleration from an internally rifled gun so as to provide the round or projectile with spin. Therefore, it is not applicable to ordinary mortar shells or rockets.

Thus it will be seen that I have provided a safing and arming unit 4 which may be of very small size, since it requires a small number of simple parts, and which is responsive to the combination of high acceleration or set-back followed by high spin to remove the barrier and permit the setting off of the explosive charge by the detonator, thereby assuring that the explosive charge will not be accidentally detonated during storage, handling, transportation or even after firing until the shell is at a safe distance from the firing gun.

While I have illustrated and described a single specific embodiment of my invention, it will be understood that this is by way of illustration only and that various changes and modifications may be contemplated in my invention within the scope of the following claims.

I claim:

1. In a weapon subject to a sequence of acceleration followed by spin, including a detonator and an explosive charge, the improvement comprising a barrier comprising two superimposed blocks, each having a curved end, which blocks are located between said detonator and explosive charge to normally form an obstruction to prevent accidental detonation of said explosive charge by said detonator, a split cylinder surrounding said blocks, mechanical locking means for normally locking said barrier in place to provide said obstruction, said mechanical locking means responsive to said sequence of acceleration followed by spin in predetermined amounts to remove said barrier and provide an unobstructed path between said detonator and explosive charge.

2. A weapon as recited in claim 1 wherein said mechanical locking means includes a spirally wound ribbon, restraining means normally engaging the outer surface of said ribbon to prevent premature unwinding of said ribbon, said restraining means being responsive to said acceleration to disengage said ribbon and permit unwinding thereof as a consequence of said spin.

3. A weapon as recited in claim 2 wherein said restraining means comprises pin means.

4. A weapon as recited in claim 3 wherein said pin means comprises a pair of pins located at two diametrically opposite spots along the perimeter of the said ribbon and held in place by a thin foil which can be punctured by said pins under high acceleration or set-back to remove the pins from restraining engagement with said outer surface of said ribbon.

5. The weapon recited in claim 4 together with means for receiving said pins after puncturing said foil, comprising tubular receptacles of substantially larger diameter than said pins in a radially outward direction from the spin axis.

* * * * *